US007658664B2

(12) United States Patent
Tong

(10) Patent No.: US 7,658,664 B2
(45) Date of Patent: Feb. 9, 2010

(54) EXERCISE OR TOY FOAM SWORD AND METHOD OF MAKING SAME

(75) Inventor: Io Lon Tong, Guangdong (CN)

(73) Assignee: Buzz Bee Toys, Inc., Mt. Laurel, NJ (US)

( * ) Notice: Subject to any disclaimer, the term of this patent is extended or adjusted under 35 U.S.C. 154(b) by 176 days.

(21) Appl. No.: 11/685,813

(22) Filed: Mar. 14, 2007

(65) Prior Publication Data

US 2007/0218803 A1 Sep. 20, 2007

(30) Foreign Application Priority Data

Mar. 14, 2006 (CN) ..... 2006 2 0056099 U

(51) Int. Cl.
*A63H 33/30* (2006.01)
*A63H 33/00* (2006.01)

(52) U.S. Cl. ..... 446/473; 482/13; 273/403

(58) Field of Classification Search ..... 446/473, 446/486; 273/403; 463/47.2; 482/12
See application file for complete search history.

(56) References Cited

U.S. PATENT DOCUMENTS 1,490,651 A * 4/1924 Waldorf ..... 463/47.2
1,717,932 A 6/1929 Miller
2,669,062 A 2/1954 Baggott
4,079,936 A 3/1978 Schachter
4,080,751 A 3/1978 Copstead
4,705,273 A 11/1987 Ament et al.
4,892,303 A 1/1990 Lohre
5,127,871 A 7/1992 Miller
5,219,163 A 6/1993 Watson
5,295,926 A 3/1994 Tanabe
5,324,227 A 6/1994 Yuh-Ching
5,389,033 A 2/1995 Rauch
5,598,596 A 2/1997 Jones et al.
5,630,998 A 5/1997 Parsons
6,010,435 A 1/2000 Tanabe
6,036,602 A 3/2000 Abbott
6,497,619 B2 12/2002 Dowdy et al.
7,261,654 B2 8/2007 Cheng
7,278,898 B2 10/2007 Kim et al.
7,350,785 B2 * 4/2008 Lewis ..... 273/403
2001/0051542 A1 12/2001 Dowdy et al.
2004/0116187 A1 6/2004 Robyor
2004/0127292 A1 7/2004 Chan et al.
2004/0162003 A1 8/2004 Vanaver
2007/0111636 A1 5/2007 Hatherly

* cited by examiner

*Primary Examiner*—Kien T Nguyen
(74) *Attorney, Agent, or Firm*—Volpe and Koenig, PC

(57) ABSTRACT

A foam sword having a sword blade made from a flexible, soft foam material is provided. The blade includes a reinforcing rod that extends partially therethrough to provide some rigidity and to which the sword handle and hilt guard are connected.

18 Claims, 2 Drawing Sheets

EXERCISE OR TOY FOAM SWORD AND METHOD OF MAKING SAME

BACKGROUND

The present invention is directed to a toy or exercise implement, in particular to a light and colorful foam sword which can be used as a toy or in connection with exercise, and is therefore suitable for a variety of users without any age limit. With economic growth and increased living standards, more and more adults are paying attention to their health. One way of improving health is to engage in more exercise with one known exercise being engaging in sword play or practicing sword dance. This is generally done with a wooden sword or plastic sword.

In addition, children often engage in toy sword play using sticks, rigid plastic swords or the like. The existing plastic swords are generally rigid or made of non-environmentally PVC blow molded material. Based on the rigid formation of the toy sword blades, it is easy for children to become injured making such items a safety hazard. In particular, children can be poked in the eyes or have bruises on their hands or arms when they get carried away with toy sword play.

It would be desirable to provide an exercise or toy sword which overcomes the difficulties and problems with the prior designs, which is light weight and soft, making it desirable for use with exercise and also for use as a children's play toy.

SUMMARY

Briefly stated, the present invention provides a foam sword having a sword blade formed from a flexible, soft foam material having first and second ends. A longitudinally extending opening extends from the first end at least partially therethrough. A reinforcing rod is located in the opening and extends for at least a portion of a length of the blade. The handle connection portion of the reinforcing rod extends out from the first end of the blade. The handle has an opening defined at least partially there through and is located on the handle connection portion of the reinforcing rod. A foam hilt guard extends from a first end of the handle to a second end of the handle.

In another aspect, the present invention provides a method of making a form sword. The method includes:

Cutting a length of extruded tubular foam material to form a foam sword blade;

Positioning a first end of a foam hilt guard on a portion of a support rod;

Positioning a handle on the support rod with a first end of the handle adjacent to the first end of the foam hilt guard;

Connecting a second end of the foam hilt guard to a second end of the handle; and Inserting a second portion of the support rod that extends from the handle and the foam hilt guard at least partially into the first end of the tubular foam material blade.

Preferably, the foam blade is made from a PE (polyethylene) foam and the handle and hilt guard are made from EVA (ethylene vinyl acetate) closed cell foam.

In a preferred embodiment, the reinforcing rod is a tube, preferably made from PP (polypropylene). This arrangement provides a foam sword having a soft blade with a flexible core formed by the reinforcing rod which extends at least partially therethrough, and in a preferred embodiment more than halfway through the length of the blade.

In a preferred embodiment, the sword can be economically and easily manufactured by using an extruded PE foam tube in order to form the sword blade and a plug can be inserted at the end of the sword blade, in order to cover the remaining opening.

BRIEF DESCRIPTION OF THE DRAWING(S)

The foregoing summary, as well as the following detailed description of the preferred embodiment of the present invention will be better understood when read in conjunction with the appended drawings. For the purposes of illustrating the invention, there is shown in the drawings an embodiment which is currently preferred. It should be understood, however, that the invention is not limited to the precise arrangement shown.

DETAILED DESCRIPTION OF THE PREFERRED EMBODIMENT(S)

Figure 1:
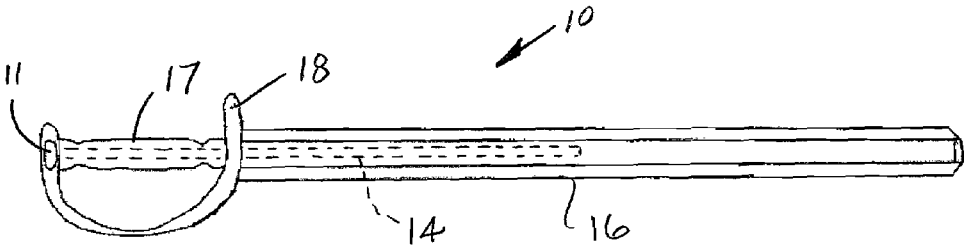
FIG. 1 is a side view of a foam sword according to the invention.

Certain terminology is used in the following description for convenience only and is not considered limiting. The words "left", "right", "lower" and "upper" designate directions in the drawings to which reference is made. Additionally, the terms "a" and "one" are defined as including one or more of the referenced item unless specifically noted.

Figure 2:
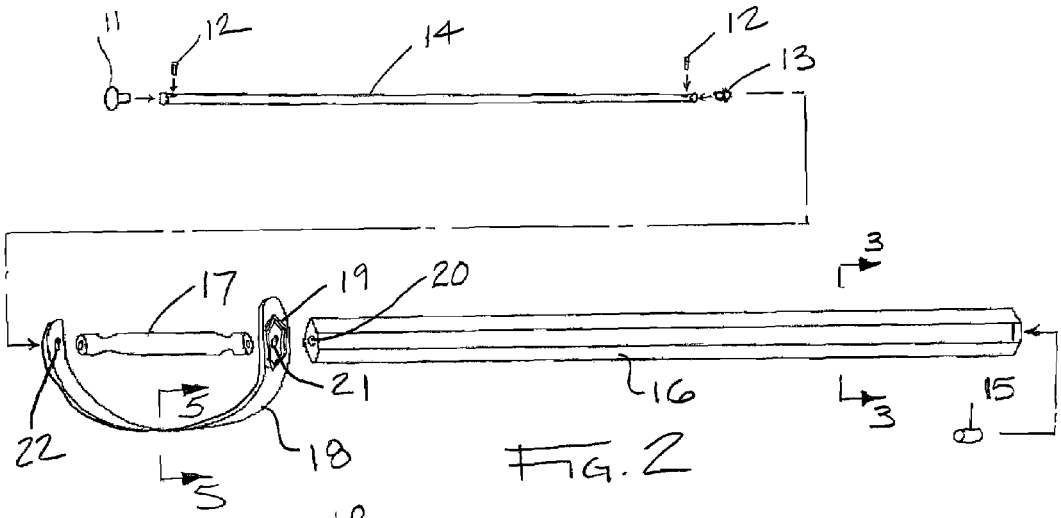
FIG. 2 is an exploded assembly view of the sword of FIG. 1.
Figure 3:
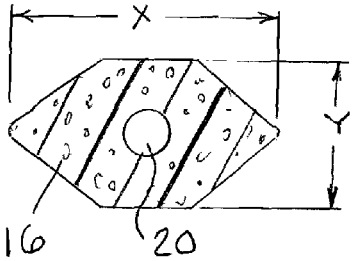
FIG. 3 is a cross-sectional view through the sword blade of the foam sword taken along lines 3-3 in FIG. 2.

Referring now to FIG. 1, a foam sword 10, which can be used for exercise or as a toy, is shown. The foam sword 10 includes a sword blade 16 formed from a flexible, soft foam material and having first and second ends. A longitudinally extending opening 20, shown in FIGS. 2 and 3, extends from the first end of the sword blade 16 at least partially therethrough. In the preferred embodiment, the sword blade 16 is an extruded foam tube and the opening 20 extends completely therethrough. As shown in FIG. 2, a plug 15 is located in the opening 20 of the second end of the sword blade 16 in order to close the opening and present a sword-like appearance. Preferably, the sword blade 16 is formed from PE (polyethylene) foam. In the preferred embodiment, the extruded foam tube used to make the sword blade 16 has a cross-section as shown in FIG. 3 with a major dimension X and a minor dimension Y to provide a blade-shape cross section. Preferably, the edges of the sword blade 16 in a direction of the major dimension X are tapered to a rounded edge in order to provide a blade-like appearance. Preferably, the sword blade 16 has a gray color. However, other colors could be utilized.

A reinforcing rod 14 is preferably located in the opening 20 in the sword blade 16, and extends through at least a portion of a length of the blade 16. The reinforcing rod 14 has a portion which extends out from the first end of the blade 16 which provides a handle connection portion. The reinforcing rod 14 is more rigid than the foam sword blade 16, providing internal support, but is still flexible so that the sword blade 16 can elastically bend upon contacting an object. The rod 14 is preferably a tube formed from a polymeric material, such as PE (polyethylene).

Preferably, the reinforcing rod 14 only extends along a partial length of the blade 16, so that an end portion of the blade 16 is less rigid and more easily deflects when contacting an object.

In a preferred embodiment, a plug 11 is inserted in a first end of the tubular reinforcing rod 14 and a cap 13 is inserted in the second end of the tubular reinforcing rod 14. Preferably, the plug 11 and cap 13 are connected to the tubular reinforcing rod by having the ends inserted into the tubular openings of the rod, and cross holes are provided through the tubular reinforcing rod 14 as well as the cap 11 and plug 13 into which cross pins 12 are inserted.

A handle 17 having an opening defined at least partially there-through is located on the handle connection portion of the reinforcing rod 14. The handle is preferably formed from an EVA (ethylene vinyl acetate) foam material. However, any other suitable materials could be utilized. In a preferred embodiment, the opening extents through the handle.

A hilt guard 18, preferably made of a flexible foam material, extends from the first end of the handle 17 to a second end of the handle 17. As shown in detail in FIG. 2, the foam hilt guard 18 has a first hole 21 defined at a first end thereof and a second hole 22 defined at a second end thereof. The first end of the foam hilt guard 18 is located between the handle 17 and the foam blade 16. The reinforcing rod 14 extends through the first hole. In the preferred embodiment, the cap 11 that is connected to the reinforcing rod 14 is located over the second hole defined at the second end of the hilt guard 18 in order to hold the second end of the hilt guard 18 to the handle 17.

As shown in FIGS. 1 and 2, the end of the sword blade 16 is preferably chamfered on at least two sides.

Figure 4:
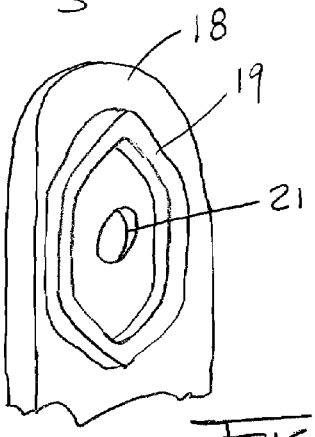
FIG. 4 is an enlarged view of a portion of the hilt guard that extends around the handle of the sword shown in FIGS. 1 and 2.

Referring to FIG. 4, preferably a handle-blade connection cover 19 is optionally located on the hilt guard 18 and is preferably formed from the same material as the hilt guard 18. This provides a socket-like overlap between the hilt guard 18 and the handle end of the blade 16. This improves the aesthetic appearance of the sword 10.

Preferably, the sword 10 is assembled by applying an adhesive to at least one of the handle 17, the foam hilt guard 18 and the sword blade 16 and/or to the reinforcing rod that extends therethrough. The adhesive can be any suitable adhesive, for example an acrylic resin adhesive, contact cement or chloroprene.

Figure 5:
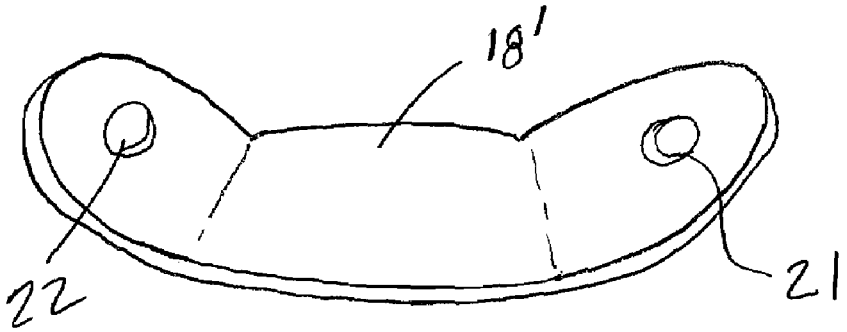
FIG. 5 is a perspective view of one embodiment of a hilt guard used in the sword of FIGS. 1 and 2.

Referring to FIG. 5, an alternate embodiment of the hilt guard 18' is shown. Those skilled in the art will recognize that the specific shape of the hilt guard can be varied as desired in order to achieve various different aesthetic appearances. The only requirement is that the distance between the holes 21 and 22 is sufficient to create enough of a bow in the hilt guard 18, 18' so that a user's hand can fit comfortably around the handle 17 inside of the area enclosed by the hilt guard 18, 18'.

Figure 6:
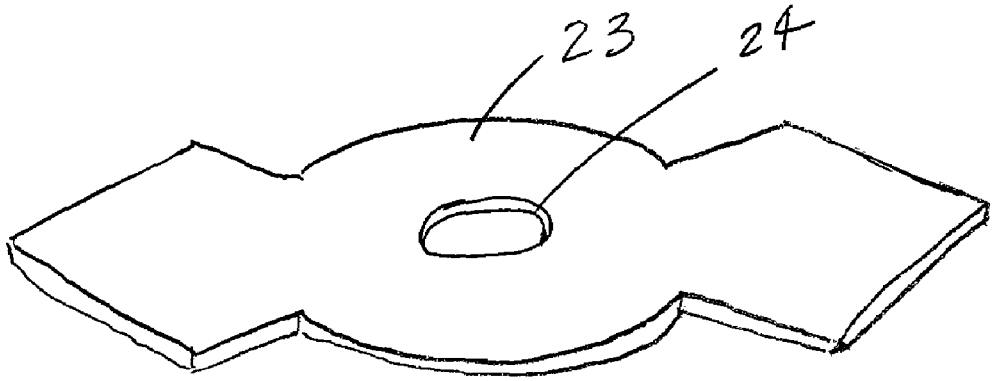
FIG. 6 is a perspective view of an alternate embodiment of a hilt guard that is usable in connection with the sword of FIGS. 1 and 2.

Referring to FIG. 6, another type of hilt guard 23 is shown having an opening 24. This hilt guard 23 is positioned on the reinforcing rod 14, between the handle 17 and the sword blade 16. No connection is made to the second end of the handle 17.

In order to make the foam sword 10 according to the invention, first an extruded tubular foam material, preferably having a flattened shape, such as that shown in FIG. 3, is cut to a length desired for the sword blade 16. A first end of the foam hilt guard 18 and the handle are positioned on the reinforcing rod 14. The second end of the foam hilt guard 18 is connected to the second end of the handle 17. This step can be omitted if the hilt guard 23 is used. Finally, a second portion of the reinforcing rod that extends from the handle 17 and foam hilt guard 18 is at least partially inserted into a first end of the tubular foam material blade 16. Preferably, the plug 15 is inserted into the second end of the blade 16. In order to connect the pieces together, adhesive is preferably applied to at least one of the handle, the foam hilt guard or the tubular foam material blade and/or to the reinforcing rod 14 that is inserted therein. The reinforcing rod 14 can be tubular material, as noted above, and to the extent that tubular material is used, plugs may optionally be inserted into the ends as shown in FIG. 2.

While the preferred embodiment of the invention has been described in detail, the invention is not limited to the specific embodiments described above, which should be considered as merely exemplary. Further modifications and extensions of the present invention may be developed, and all such modifications are deemed to be within the scope of the present invention as defined above and by the appended claims.

What is claimed is:

1. A foam sword comprising:

a sword blade formed from an extruded foam material having a blade-shaped, generally constant cross-section with a major dimension and a minor dimension, with blade edges being defined in a direction of the major dimension, the blade having first and second ends, and a longitudinally extending opening extends therethrough from the first end to the second end;

a reinforcing rod located in the opening and extending for at least a portion of a length of the blade, and having a handle connection portion extending out from the first end of the blade;

a handle having an opening defined at least partially there-through located on the handle connection portion of the reinforcing rod; and a hilt guard extending from a first end of the handle to a second end of the handle.

2. The foam sword of claim 1, wherein the hilt guard has a first hole defined at a first end thereof and a second hole defined at a second end thereof, and the first end of the hilt guard is located between the handle and the foam blade, with the reinforcing rod extending through the first hole, and the second end of the hilt guard being connected to a second end of the handle.

3. The foam sword of claim 1, wherein the handle is formed from a foam material.

4. The foam sword of claim 1, wherein the reinforcing rod is a tube formed from a polymeric material.

5. The foam sword of claim 1, wherein a plug is located in the opening at the second end of the sword blade.

6. The foam sword of claim 5, wherein the sword blade comprises polyethylene foam.

7. The foam sword of claim 5, wherein the second end of the sword blade is chamfered on at least two sides.

8. The foam sword of claim 1, wherein the handle and the hilt guard comprise ethylene vinyl acetate foam.

9. The foam sword of claim 1, wherein the reinforcing rod has a length that is greater than half of a length of the sword blade, and less than the length of the sword blade.

10. A foam sword comprising:

a sword blade formed from an extruded foam material having a blade-shaped, cross-section with a major dimension and a minor dimension, with blade edges being defined in a direction of the major dimension, the blade having first and second ends, and a longitudinally extending opening extends therethrough;

a reinforcing rod located in the opening and extending for at least a portion of a length of the blade, and having a handle connection portion extending out from the first end of the blade;

a handle having an opening defined at least partially therethrough located on the handle connection portion of the reinforcing rod;

a hilt guard extending from a first end of the handle to a second end of the handle:

the reinforcing rod is a tube formed from a polymeric material, and a plug is inserted in a first end of the tubular reinforcing rod and a cap is connected to a second end of the tubular reinforcing rod.

11. The foam sword of claim 10, wherein the plug and the cap are connected to the tubular reinforcing rod via cross pins.

12. A method of making a foam sword, comprising:

cutting a length of extruded tubular foam material having a generally constant blade-shaped cross-section with a major dimension and a minor dimension and an opening defined therethrough, with blade edges being defined in a direction of the major dimension to form a foam sword blade, said opening extends from a first end to a second end of said sword blade;

positioning a hilt guard on a portion of a reinforcing rod;

positioning a handle on the reinforcing rod with a first end of the handle adjacent to the first end of the foam hilt guard;

inserting a second portion of the reinforcing rod that extends from the handle and hilt guard at least partially into a first end of the tubular foam material blade; and inserting a plug into the opening at the second end of the foam sword blade.

13. The method of claim 12, further comprising:

connecting a second end of the foam hilt guard to a second end of the handle.

14. The method of claim 12, further comprising:

inserting a plug into a second end of the tubular foam material blade.

15. The method of claim 12, further comprising:

applying an adhesive to at least one of the handle, the foam hilt guard or the tubular foam material blade.

16. The method of claim 12, wherein the reinforcing rod is a tube.

17. The method of claim 12, further comprising forming the handle and hilt guard from a foam material.

18. A method of making a foam sword, comprising:

cutting a length of extruded tubular foam material having a generally constant blade-shaped cross-section with a major dimension and a minor dimension and an opening defined therethrough, with blade edges being defined in a direction of the major dimension to form a foam sword blade;

inserting plugs into the ends of the reinforcing rod tube;

applying an adhesive to at least one of the handle, the foam hilt guard or the tubular foam material blade;

positioning a hilt guard on a portion of the reinforcing rod;

positioning a handle on the reinforcing rod with a first end of the handle adjacent to the first end of the foam hilt guard;

inserting a second portion of the reinforcing rod that extends from the handle and hilt guard at least partially into a first end of the tubular foam material blade;

inserting a plug into the opening at the second end of the foam sword blade.

* * * * *